United States Patent [19]

Krasser

[11] 4,347,494

[45] Aug. 31, 1982

[54] BIMETAL-CONTROLLED OVERLOAD PROTECTION SWITCH

[75] Inventor: Fritz Krasser, Altdorf, Fed. Rep. of Germany

[73] Assignee: Ellenberger & Poensgen GmbH, Altdorf, Fed. Rep. of Germany

[21] Appl. No.: 310,868

[22] Filed: Oct. 13, 1981

[30] Foreign Application Priority Data

Oct. 11, 1980 [DE] Fed. Rep. of Germany ..... 3038512

[51] Int. Cl.[3] ..... H01H 73/30

[52] U.S. Cl. ..... 337/66; 337/113

[58] Field of Search ..... 337/52, 53, 62, 66, 337/112, 113, 56

[56] References Cited

U.S. PATENT DOCUMENTS

| | | | |
|---|---|---|---|
| 1,939,194 | 12/1933 | Angell | 337/62 |
| 2,886,670 | 5/1959 | Dillon | 337/66 |
| 3,751,618 | 8/1973 | Hallerberg | 200/159 R |
| 3,975,702 | 8/1976 | Carpenter | 337/62 |

*Primary Examiner*—William H. Beha, Jr.
*Attorney, Agent, or Firm*—Spencer & Kaye

[57] ABSTRACT

In an overload protection switch including a narrow housing, bimetal strips mounted in the housing, a pushbutton mounted in, and projecting out of, the housing and made of insulating material, the pushbutton being provided with a partition and being movable relative to the housing between an on position in which a conductive path is established via the strips and an off position in which such conductive path is broken, and a spring device urging the pushbutton into its off position, the housing and bimetal strips are physically symmetrical to the longitudinal center axis of the housing, the path of movement of the pushbutton is along that center axis, there are two identical bimetal strips disposed symmetrically relative to the center axis, each strip having a first part fastened to the housing and a second part which is movable relative to the housing in response to temperature changes, with the second parts converging toward one another while remaining out of contact, the pushbutton carries a conductive contact piece at a location such that in the on position of the pushbutton the contact piece is wedged between the strips and is held thereagainst by the force of the spring device and in the off position of the pushbutton the partition is disposed between the strips.

12 Claims, 5 Drawing Figures

BIMETAL-CONTROLLED OVERLOAD PROTECTION SWITCH

BACKGROUND OF THE INVENTION

The present invention relates to an overload protection switch of the type which is controlled by movement of a bimetal strip.

SUMMARY OF THE INVENTION

An object of the invention is to provide an overload protection switch of the above type such that it can be produced simply and economically, with long service life and good circuit-breaking functioning even after it has been tripped many times by overloading.

The above and other objects are achieved, according to the invention, in an overload protection switch including a narrow housing, bimetal strip means mounted in the housing, a pushbutton mounted in, and projecting out of, the housing and made of insulating material, the pushbutton being provided with a partition and being movable relative to the housing between an on position in which a conductive path is established via the strip means and an off position in which such conductive path is broken, and spring means urging the pushbutton into its off position, by: forming the housing and the bimetal strip means to be physically symmetrical to the longitudinal center axis of the housing; causing the path of movement of the pushbutton to be along that center axis; constituting the bimetal strip means of two identical bimetal strips disposed symmetrically relative to the center axis, each strip having a first part fastened to the housing and a second part which is movable relative to the housing in response to temperature changes, with the second parts converging toward one another while remaining out of contact; providing the pushbutton with a conductive contact piece at a location such that in the on position of the pushbutton the contact piece is wedged between the strips just beyond the location where the second parts are closest to one another to be held by the second parts against the force of the spring means and in the off position of the pushbutton the partition is disposed between the strips at the location where the second parts are closest to one another.

The spring pressure exerted on the pushbutton is dimensioned such that in the normal "ON" position of the switch, this spring pressure is not sufficient to deflect the strips so as to press the contact piece completely through the wedge formed between the contact edges on the second parts of the bimetallic strips. Instead, this becomes possible only upon heating caused by an overload, so that the contact ends of the two bimetallic strips spread apart. While such tripping movement is still just beginning, sufficient contact pressure is maintained, but it is broken off abruptly with the interruption of contact which occurs when the contact piece passes through the wedge.

Preferably, the free ends of the second parts of the strips diverge beyond the location where the second parts are closest to one another, such divergence being in the direction of movement of the second parts in response to temperature changes. This promotes, in a simple fashion, the spreading apart of the contact ends of the bimetallic strips while restoring the contact piece from the tripped overload position back to the "ON" position, which is accomplished simply by pressing on the pushbutton.

The switch according to the invention can be assembled in a simple manner without restricting its functional capabilities.

Preferred embodiments assure particularly good contact between the ends of the bimetallic strips and the contact piece, without the ends of the bimetallic strips requiring specialized working of their surface in the contact areas. Instead, contact is established directly with the contact piece on the part of the two forked ends of one bimetallic strip.

The invention permits a simple design of the contact piece, which furthermore promotes passage through the wedge when the switch is tripped by an overload.

As a result of further features of the invention, tilt-free guidance of the pushbutton is promoted with a long lever arm which counteracts any tilting stress which may occur.

As a result of additional features of the invention, the guidance of the pushbutton on the inside of the two housing walls is effected not over the entire surface area of the pushbutton but rather only in those areas which are required for satisfactory guidance.

The invention further facilitates secure fastening of the two bimetallic strips inside the housing by the simple insertion of two units, each comprising a bimetallic strip and a contact plate, into the space between housing protrusions which project from the two lateral walls of the housing. The extent to which the contact plates protrude results in favorable lever ratios for positional fixation.

By means of further features of the invention, the contact plates also assume the function of terminal contacts of the switch. The contact plates can also be put to use in guiding the pushbutton, and fabrication and assembly of the switch can be achieved in a simple manner.

The subject of the invention will be described in further detail with the aid of an exemplary embodiment shown in the drawings.

DESCRIPTION OF THE PREFERRED EMBODIMENTS

Figure 2:
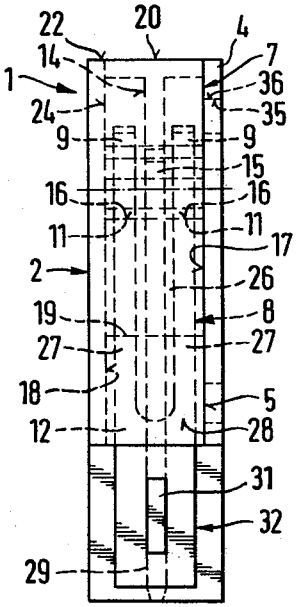
FIG. 2 is a side view in the direction of arrow II of FIG. 1.

The switch shown in the drawing includes a housing 1 composed of a housing base 2 presenting lateral walls enclosing the moving parts of the switch and a cover 4 articulated to the base by means of thin wall areas forming film hinges 3. The housing base 2 and the cover 4 are fabricated in one piece from plastic. The housing as a whole has a flat structural shape favoring the sequential disposition of a multiplicity of switches to make a narrow switch array. The cover 4 contacts base 2 at a surface 5 which extends parallel to the central longitudinal axis of the housing, that axis being parallel to, or in, the plane of FIGS. 1 and 3.

Figure 1:
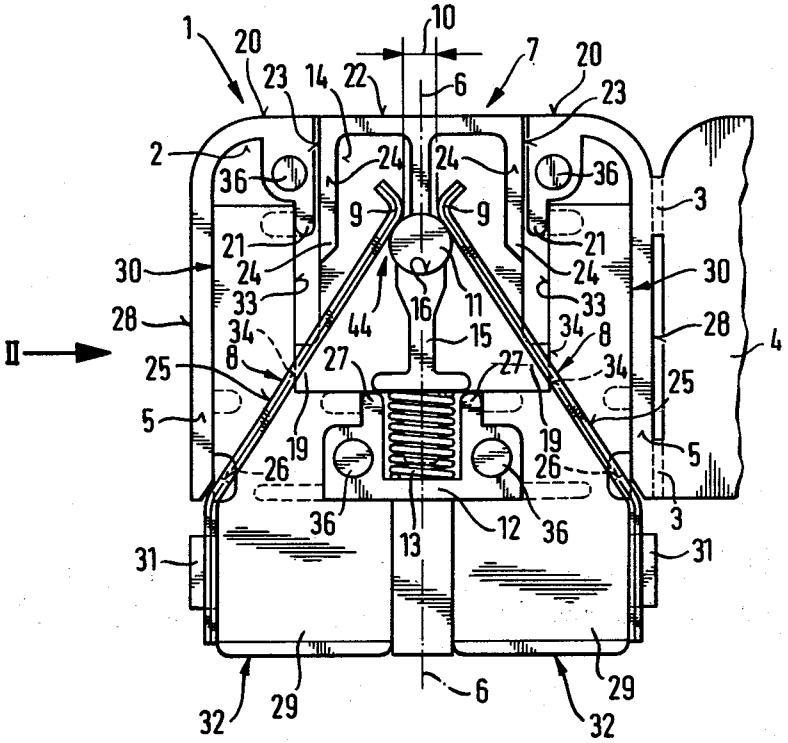
FIG. 1 is a plan view of a preferred embodiment of the overload protection switch according to the invention in the contact-closing position and with the top of the housing removed.
Figure 4:
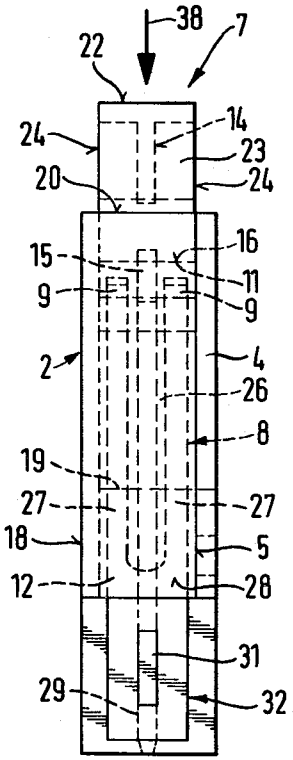
FIG. 4 is a view similar to that of FIG. 2 in the direction of arrow IV of FIG. 3.
Figure 3:
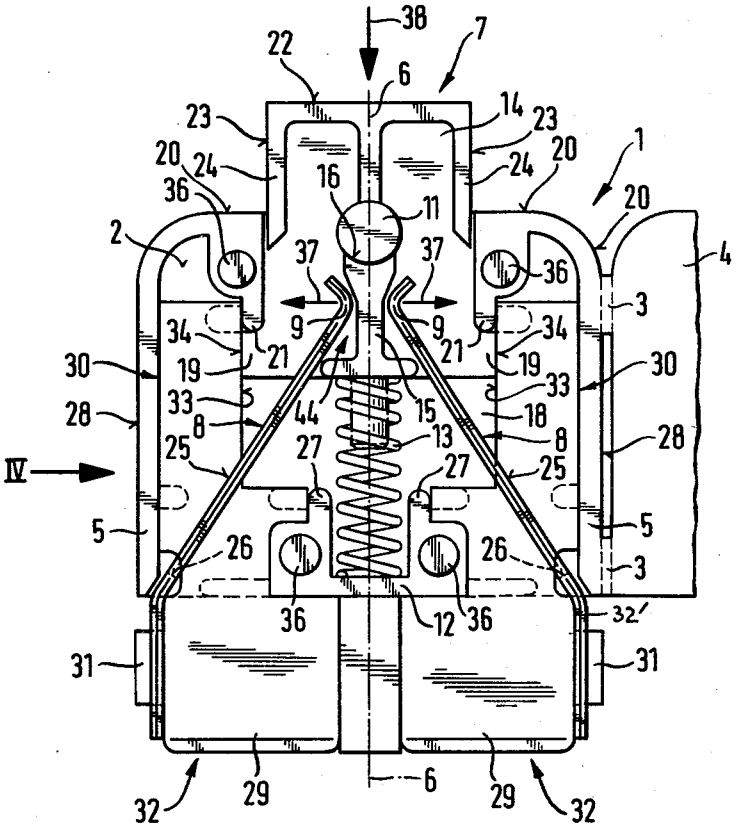
FIG. 3 is a view similar to that of FIG. 1, but in which the switch is in the overload-tripped position.
Figure 5:
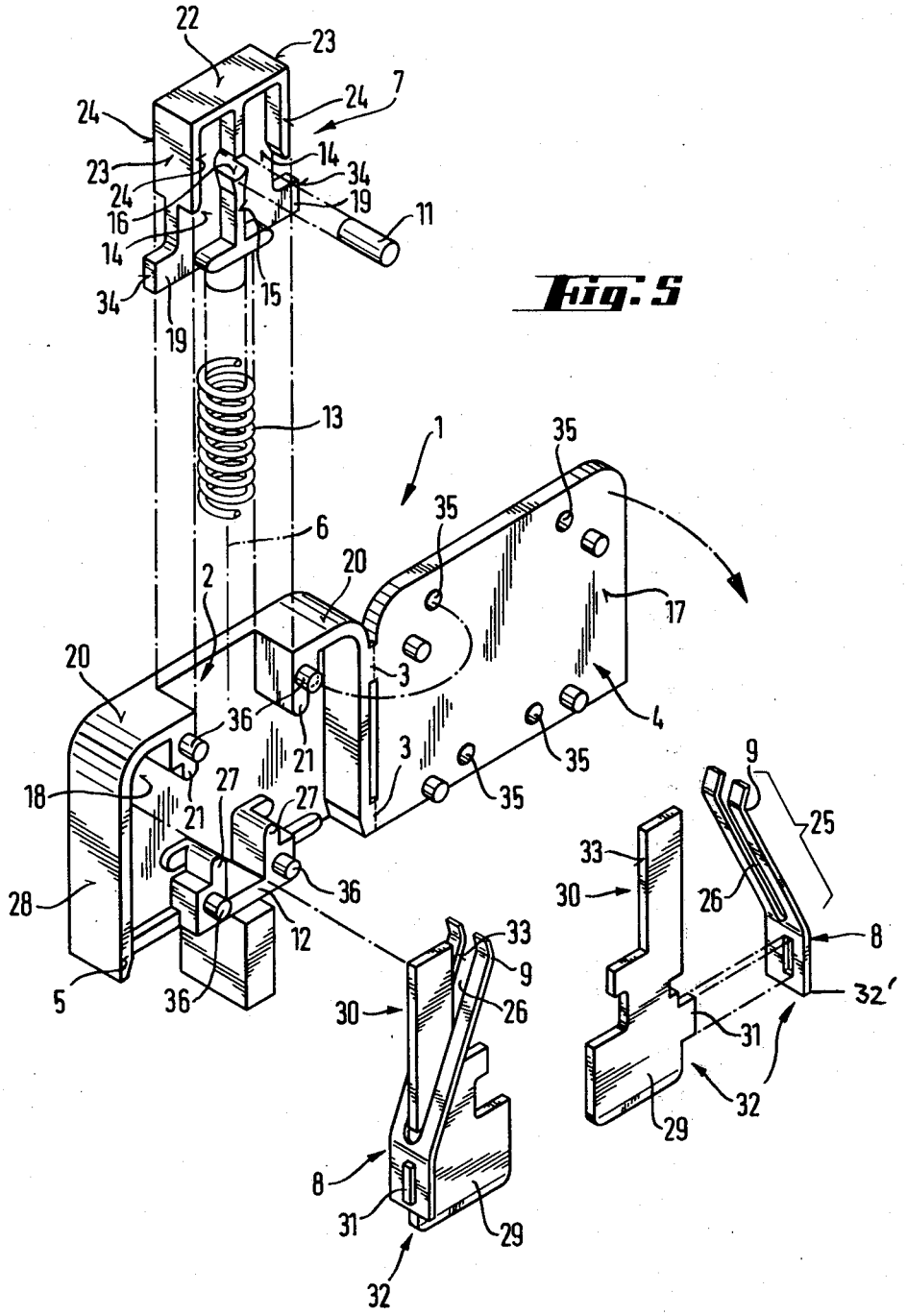
FIG. 5 is an exploded perspective view of the switch showing all its individual parts.

The housing 1 and its moving parts are constructed to be metrical with respect to the central axis 6 of a pushbutton 7, which coincides with the axis of movement, or to the transverse housing plane passing through the central axis 6 and extending perpendicularly to the plane of FIGS. 1 and 3.

At either side of the central axis 6, two bimetallic strips 8 which are identical and mounted in mirror image symmetry to one another are secured on the base part 2 of the housing 1. The moving parts of strips 8 having the contact ends 9 extend outwardly toward one another and toward the axis 6 of the pushbutton, like the sides of an angle but without meeting directly at the vertex. Instead, a space 10 always remains between the two contact ends 9. In the contact-closing position shown in FIG. 1, this distance 10 is bridged by a contact piece 11, which thus acts as a contact bridge. The contact piece is carried by the pushbutton 7.

The pushbutton 7 is urged in the direction of the pushbutton axis 6, that is in the contact-opening direction, by a compression spring 13 supported on a lateral wall 12 of the housing base 2. The compression spring 13 forces the contact piece 11, which is connected with the pushbutton 7, into its contact-closing position, that is into the wedge 44 formed between the contact ends 9 of the bimetallic strips 8.

The body of the pushbutton 7 is constituted by a central wall 14 located in the central longitudinal axis of the housing and provided with plane-parallel surfaces. One partition 15 protrudes from either side of the central wall 14 at right angles to its surfaces and extends longitudinally in the direction of the pushbutton axis 6; these pushbutton partitions 15 are disposed below the contact piece 11 and accordingly their upper edges 16 more or less form the support for the contact piece 11.

The pushbutton 7 is guided between lateral walls 17 and 18 which form the two flat sides of the housing. The pushbutton 7 has two lateral protrusions 19 directed at the end of its central wall 14 which is directed into the housing. In the overload "OFF" position, protrusions 19 come against the end face 20 of the housing or against the housing protrusions 21 projecting from the housing wall 18.

In order to guide the pushbutton 7 in the vicinity of its head as well as to present an actuation face 22 and pushbutton sides 23, which protrude from the housing 1 when the switch is in the overload-tripped position, riblike protrusions project at either side from the covering faces of the central wall 14. In plan view, these protrusions have the shape of a letter E lying on its side with the back of the letter E coinciding with the actuation face 22. The end faces 24 at either side of each rib are in the same planes as the outer faces of the pushbutton partitions 15 and serve as guide faces for the pushbutton 7 with respect to, i.e. against, the lateral housing walls 17 and 18.

The movable parts 25 of the two bimetallic strips 8 are slit in the lengthwise direction, beginning at the contact ends 9, the slits 26 being located in the central longitudinal plane of the housing. The pushbutton 7 rests with its central wall 14 in the slits 26 of the two bimetallic strips 8 and is thus capable of moving unobstructedly between its two operating positions despite the extent to which it protrudes, in the longitudinal direction of the central longitudinal housing plane, into the bimetallic strips 8.

At either side and symmetrically relative to the central axis 6 of the pushbutton 7, or to the transverse housing plane passing through the central axis 6, two contact plates 29 are provided and are held in place by protrusions 21 and 27 from the housing wall 18 and by a lateral wall 28 of housing base 2. Each contact plate 29 has an upper portion 30 which passes through the slit 26 of a respective bimetallic strip 8, and is secured on the respective bimetallic strip 8 by means of a protrusion 31 of its lower portion 32 which is also located in the central longitudinal plane of the housing and projects outwardly by passing through the associated bimetallic strip 8. The bimetallic strips 8 also have lower portions 32, and together with lower portions 32 of plates 29, protrude downwardly out of the housing 1 and constitute connecting terminals of the switch.

The protrusions 31 of the contact plates 29 which project outwardly beyond the connecting terminals 32, 32' thus form connectors which are diametrically opposed to one another, like the terminals of plug-in overload protectors which can be inserted at either side between cooperating contacts.

The edges 33 facing one another in the upper portions 30 of the contact plates 29 extend parallel to the central axis 6. The lateral protrusions 19 at the interior end of the pushbutton 7, which are part of its central wall 14, have lateral edges 34 extending parallel to the central axis 6 and are thus likewise guided in that they rest against the edges 33 of the upper portions 30 of the contact plates 29.

Plates 29 are isolated from one another by a protrusion specially provided on housing base 2 for that purpose.

The lateral housing wall 17 is provided with recesses 35 and the housing wall 18 is provided with corresponding protrusions 36 achieving a press-fit fastening together of housing parts 2 and 4. When these housing parts are pivoted toward one another and pressed together, these elements 35 and 36 can snap into engagement, thus providing a firm, positive connection. Ultrasound welding between the recesses 35 and the protrusions 36 is also possible.

The "ON" position of the overload protection switch shown in FIG. 1 has already been discussed above. When the bimetallic strips 8 are heated by an overload, their contact ends 9 move in the direction indicated by the arrows 37 in FIG. 3, thus increasing the spacing 10 therebetween. The contact piece 11 connected with the pushbutton 7, is then pushed by the compression spring 13 completely through the space between the contact ends 9 with a snapping effect, thus effecting an instantaneous shutoff of the switch.

The pushbutton partitions 15 disposed at either side of the central wall 14 below the contact piece 11 are located, in the "OFF" position shown in FIG. 3, in the space between the two contact ends 9, so that even after the bimetallic strips 8 are once again cold, the contact ends 9 cannot approach one another closely or come into mutual contact.

In order to be able to return the switch again from the "OFF" position shown in FIG. 3 to the contact-closing position shown in FIG. 1, the pushbutton 7 needs merely to be depressed in the direction of the arrow 38. The contact piece 11 then engages the outsides of the mutually diverging contact ends 9, and slides into the contact-closing position shown in FIG. 1, spreading the two contact ends 9 apart as it does so.

It will be understood that the above description of the present invention is susceptible to various modifications, changes and adaptations, and the same are intended to be comprehended within the meaning and range of equivalents of the appended claims.

What is claimed is:

1. In an overload protection switch including a narrow housing, bimetal strip means mounted in the housing, a pushbutton mounted in, and projecting out of, the housing and made of insulating material, the pushbutton being provided with a partition and being movable relative to the housing between an on position in which a conductive path is established via the strip means and an off position in which such conductive path is broken, and spring means urging the pushbutton into its off position, the improvement wherein:

said housing, said pushbutton and said bimetal strip means are physically symmetrical to the longitudinal center axis of said housing;

the path of movement of said pushbutton is along that center axis;

said bimetal strip means comprise two identical bimetal strips disposed symmetrically relative to the center axis, each strip having a first part fastened to said housing and a second part which is movable relative to said housing in response to temperature changes, with said second parts converging toward one another while remaining out of contact;

said pushbutton carries a conductive contact piece at a location such that in the on position of said pushbutton said contact piece is wedged between said strips just beyond the location where said second parts are closest to one another to be held by said second parts against the force of said spring means and in the off position of said pushbutton said partition is disposed between said strips at the location where said second parts are closest to one another.

2. A switch as defined in claim 1 wherein the free ends of said second parts of said strips diverge beyond the location where said second parts are closest to one another, such divergence being in the direction of movement of said second parts in response to temperature changes.

3. A switch as defined in claim 1 or 2 wherein said housing presents two flat lateral walls and an end wall disposed between said lateral walls, and said pushbutton is guided between said lateral walls for movement between its said positions and is provided with two lateral protrusions which bear against said end wall when said pushbutton is in its off position.

4. A switch as defined in claim 1 or 2 wherein:

said pushbutton and said bimetal strips are symmetrical to a longitudinal plane containing the longitudinal center axis;

said second part of each said strip is provided with a slit extending in the direction of the center axis and centered on the plane passing through the longitudinal center axis and extending perpendicular to the narrow dimension of said housing, said slit extending in the direction of movement of said second part;

said pushbutton comprises a central wall portion extending along said last-recited plane and having flat, parallel sides, said wall portion extending into said slits; and said contact piece and said partition extend to both sides of said central wall portion.

5. A switch as defined in claim 4 wherein said contact piece is a bolt passing perpendicularly through said central wall portion of said pushbutton.

6. A switch as defined in claim 5 wherein said bolt has a cylindrical shape.

7. A switch as defined in claim 3 wherein said pushbutton is guided between said lateral walls via outer surfaces of said partition.

8. A switch as defined in claim 7 wherein said pushbutton comprises side portions having lateral edges coplanar with the outer surfaces of said partition.

9. A switch as defined in claim 1 or 2 wherein:

said second part of each said strip is provided with a slit extending in the direction of the longitudinal center axis and centered on the plane passing through the longitudinal center axis and extending perpendicular to the narrow dimension of said housing, said slit extending in the direction of movement of said second part; said switch further comprises two contact plates disposed symmetrically relative to the longitudinal center axis of said housing and extending parallel to, and disposed in, a plane containing that axis and extending perpendicular to the narrow dimension of said housing; each said contact plate includes first and second portions with said first portion of each said plate passing through said slit of a respective strip, and said second portion of each said plate having a protrusion via which said plate is secured to a respective strip; and each said contact plate is held immovably in said housing.

10. A switch as defined in claim 9 wherein said first part of each said strip projects out of said housing, and said protrusions of said plates project diametrically away from one another and away from said first portions of said contact plates to constitute terminals of plug-in overload protectors which can be inserted into cooperating contacts.

11. A switch as defined in claim 9 wherein said first portions of said plates have respective edges facing one another and extending parallel to the longitudinal center axis of said housing, and said pushbutton comprises a central wall provided with two oppositely directed lateral protrusions presenting respective side edges extending parallel to the longitudinal center axis of said housing and contacting said edges of said first portions of said plates for guiding the movement of said pushbutton.

12. A switch as defined in claim 1 or 2 wherein said housing comprises two housing parts joined together along a plane perpendicular to the narrow dimension of said housing, said two parts being injection molded as a one piece unit further having a thin-walled portion joining said parts together and constituting an integral hinge via which said parts are pivotal relative to one another, and said parts being provided with components for securely fastening said parts to one another when they are joined together.

* * * * *